US006272734B1

(12) United States Patent
Kern

(10) Patent No.: US 6,272,734 B1
(45) Date of Patent: Aug. 14, 2001

(54) PROCESS FOR MANUFACTURING AN ELECTROMAGNETIC RELAY

(75) Inventor: Josef Kern, Berlin (DE)

(73) Assignee: Tyco Electronics Logistics AG, Steinach (CH)

( * ) Notice: Subject to any disclaimer, the term of this patent is extended or adjusted under 35 U.S.C. 154(b) by 0 days.

(21) Appl. No.: 09/214,743

(22) PCT Filed: Jun. 17, 1997

(86) PCT No.: PCT/DE97/01229

§ 371 Date: Jan. 11, 1999

§ 102(e) Date: Jan. 11, 1999

(87) PCT Pub. No.: WO98/01878

PCT Pub. Date: Jan. 15, 1998

(30) Foreign Application Priority Data

Jul. 10, 1996 (DE) ..... 196 27 845

(51) Int. Cl.[7] ..... H01F 7/129; H01H 51/28

(52) U.S. Cl. ..... 29/602.1; 29/622; 29/606; 29/827; 335/80; 335/83; 335/152; 264/272.19; 264/272.2

(58) Field of Search ..... 29/602.1, 622, 29/604, 606, 876, 883, 827; 335/80, 83, 84, 151, 152, 153, 154, 230; 264/272.19, 272.2, 272.14, 272.15

(56) References Cited

U.S. PATENT DOCUMENTS

| | | | | |
|---|---|---|---|---|
| 4,551,698 | * | 11/1985 | Aidn | 335/78 |
| 4,993,787 | * | 2/1991 | Tanaka et al. | 335/80 |
| 5,015,979 | * | 5/1991 | Nakanishi et al. | 335/83 |
| 5,038,122 | * | 8/1991 | Nakayama et al. | 335/83 |
| 5,109,209 | * | 4/1992 | Ida et al. | 264/272.19 |
| 5,131,138 | * | 7/1992 | Crouse | 264/272.19 |
| 5,148,136 | * | 9/1992 | Kidd | 335/83 |
| 5,153,543 | * | 10/1992 | Hitachi et al. | 335/80 |
| 5,250,919 | | 10/1993 | Schedele . | |
| 5,473,297 | * | 12/1995 | Sako et al. | 335/80 |
| 5,801,608 | * | 9/1998 | Mader | 335/80 |

FOREIGN PATENT DOCUMENTS

| | | | | |
|---|---|---|---|---|
| 24 51 895 | | 5/1976 | (DE) . | |
| 25 56 610 | | 6/1977 | (DE) . | |
| 31 49 814 | | 6/1983 | (DE) . | |
| 36 20 942 | | 1/1988 | (DE) . | |
| 38 05 562 | | 5/1992 | (DE) . | |
| 0 531 890 | | 3/1993 | (EP) . | |
| 1-238109 | * | 9/1989 | (JP) | 29/602.1 |
| 4-264323 | * | 9/1992 | (JP) | 29/602.1 |
| 5-314885 | * | 11/1993 | (JP) | 29/602.1 |
| 6-69036 | * | 3/1994 | (JP) | 29/602.1 |
| WO 91/07770 | | 5/1991 | (WO) . | |

* cited by examiner

*Primary Examiner*—Allan N. Shoap
*Assistant Examiner*—A. Dexter Tugbang
(74) *Attorney, Agent, or Firm*—Schiff Hardin & Waite

(57) ABSTRACT

The relay is formed from two half-shells which are formed by extrusion coating the functional elements with plastic. A first half-shell is formed by extrusion coating a coil with a U-shaped core, while a second half-shell is formed by extrusion coating a spring support and at least one fixed contact element. A contact spring having a flat armature is attached to the spring support. The relay is adjusted and at the same time sealed by the process of joining the two half-shells.

10 Claims, 6 Drawing Sheets

Figure 1:
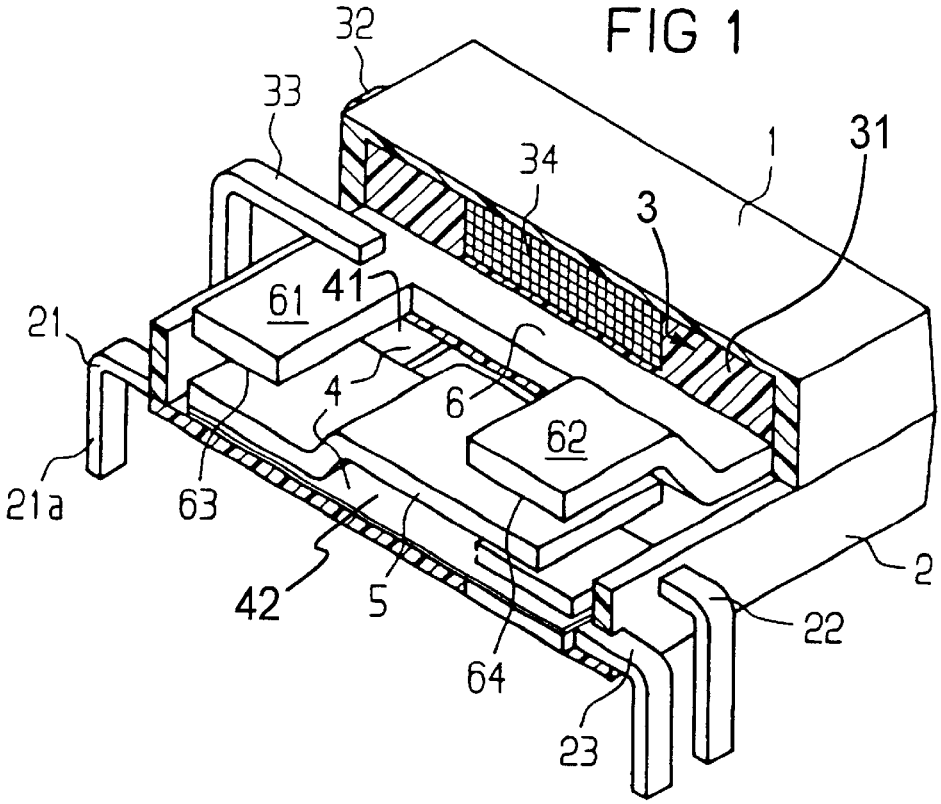

33
32
61
1
63
62
64
11
34

46
44
41
21

4
2
5
23
23a
22
22a

PROCESS FOR MANUFACTURING AN ELECTROMAGNETIC RELAY

BACKGROUND OF THE INVENTION

The invention relates to a method for producing an electromagnetic relay having

- a coil through which a core passes and which has a winding and connecting pins, the core forming pole plates at both ends outside the coil,
- an armature which bridges the pole plates forming air gaps, and
- a contact arrangement having a contact spring which is operated by the armature and having at least one fixed contact element which interacts with the contact spring.

EP 0 531 890 A1 describes a switching relay as well as a method for its production, the relay elements being arranged in the manner mentioned above in a twopart housing. There, the two housing parts in fact do not form a closed housing, but merely a base which is preferably a printed circuit board with an integrally formed side wall and a cover part, between which a housing gap remains open even after the parts have been joined together. The relay there is preferably designed as a multiple relay with a row of magnet systems located alongside one another, a common core pole plate resting on the base and forming a row of vertically projecting core sections, onto each of which a coil is fitted. Each system also has a U-shaped armature, which is mounted on the core pole plate and, with the contact spring, encloses the coil like a frame. The cover part has slits with mating contact elements and spring supports inserted therein, and these slits are likewise not sealed. In general in the case of the relay there, a conventional manufacturing technique is used, the individual elements subsequently being mounted on one or the other housing part by plugging-on, riveting or in a similar way.

SUMMARY OF THE INVENTION

The aim of the present invention is cost-effective production of relays of the type mentioned initially for different sizes and applications. The aim in this case is to achieve high manufacturing accuracy for the mechanical relay characteristics without any specific operation being required for adjustment.

This aim is achieved according to the invention by a method which comprises the following steps:

- the coil which is provided with the core is embedded in plastic with its connecting pins forming a first housing half-shell,
- a spring support for the contact spring and at least one fixed contact element are embedded in plastic forming a second housing half-shell,
- the armature is inserted into one of the two half-shells, and
- the two half-shells are connected by their edges such that they rest on one another forming a seal.

The production of the relay housing, which is envisaged according to the invention, in the form of two plastic half-shells in which the functional elements are anchored by embedding, results not only in all the parts being accurately fixed in position, but at the same time also results in a simple and effective sealing of the housing, since the connecting elements of the relay are sealed in tight just by the embedding process, and the edges of the two half-shells just rest on one another in the form of plastic surfaces which can easily be sealed. All the parts are preferably produced and joined to one another by an injection-molding assembly. This results in a high level of manufacturing accuracy, since the accurate injection mold governs the position tolerance of the individual parts. These individual parts are preferably manufactured from flat sheet-metal strips and are extrusion coated successively or simultaneously. This injection-molding assembly is particularly well suited to manufacture by means of the cyclic extrusion coating of parts which are attached to the strip, by which means large quantities can be produced in a correspondingly cost-effective manner.

Refinements and developments of this general production method are specified in the dependent claims.

The invention will be explained in more detail in the following text using exemplary embodiments.

BRIEF DECRIPTION OF THE DRAWINGS

Figure 2:
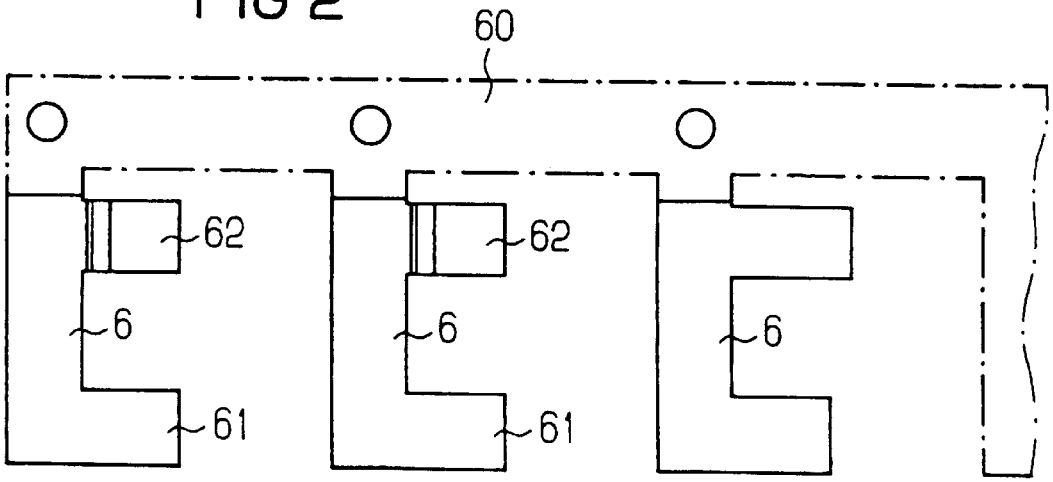
Figure 3:
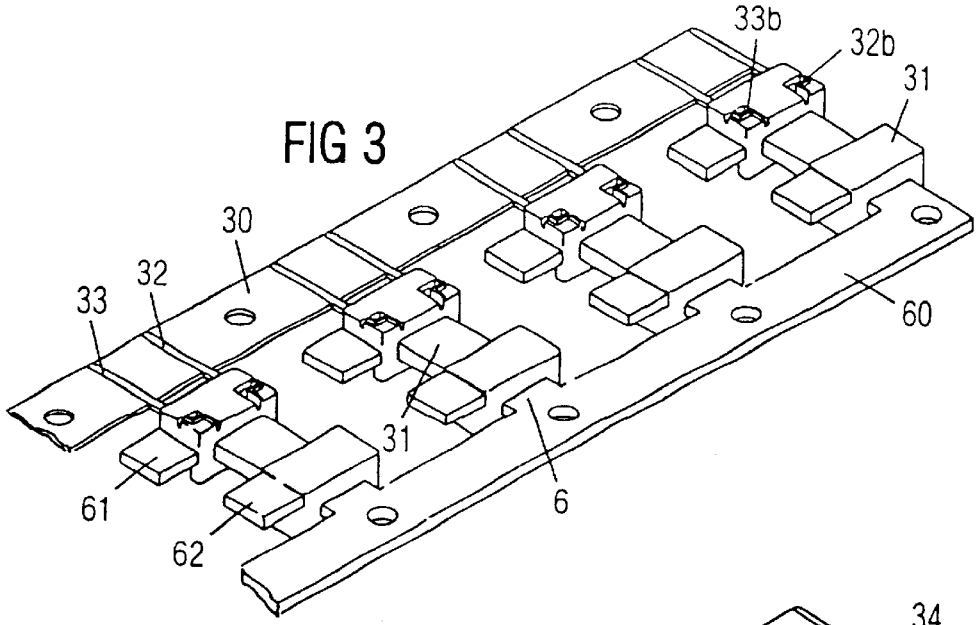
Figure 4:
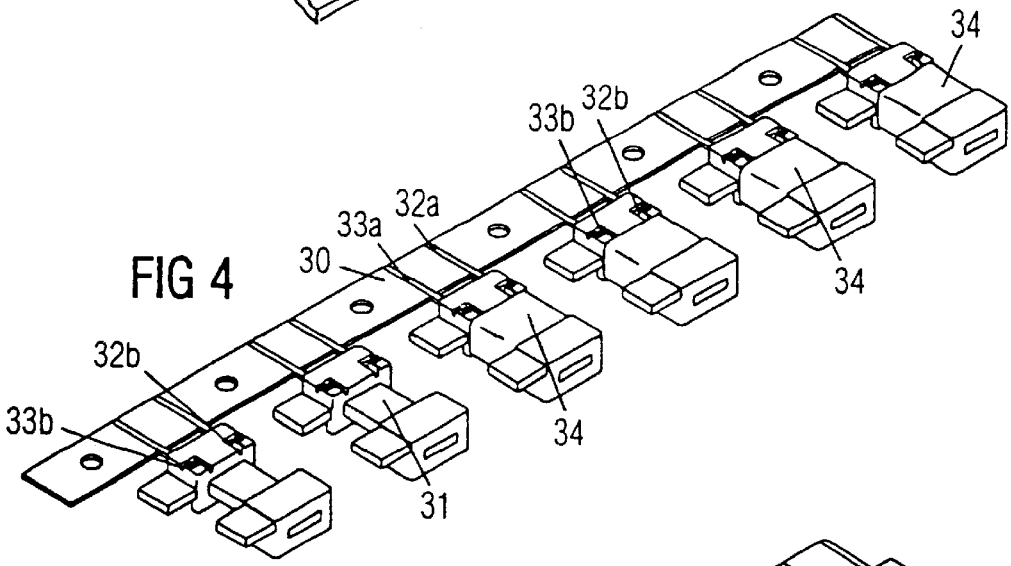
Figure 5:
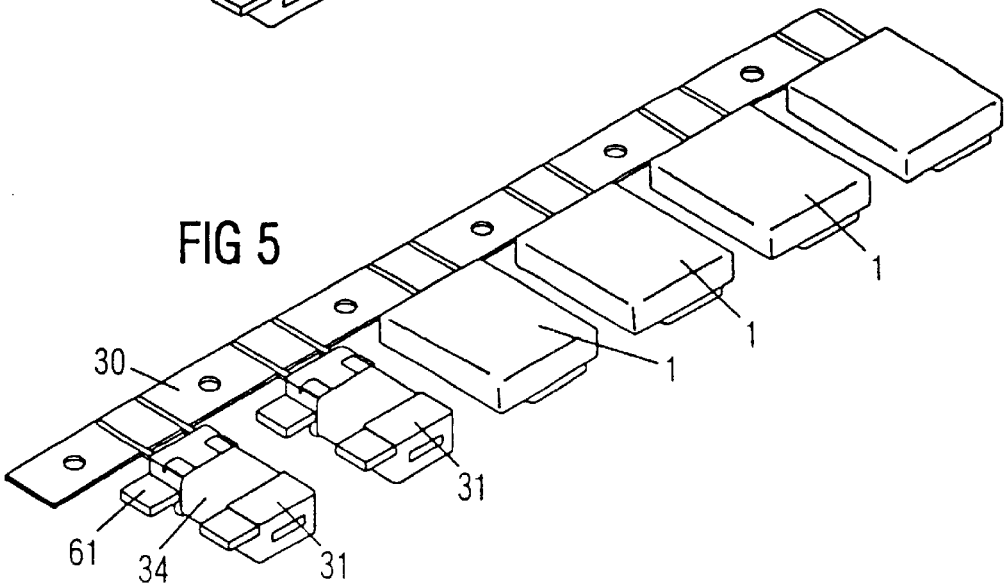
Figure 6:
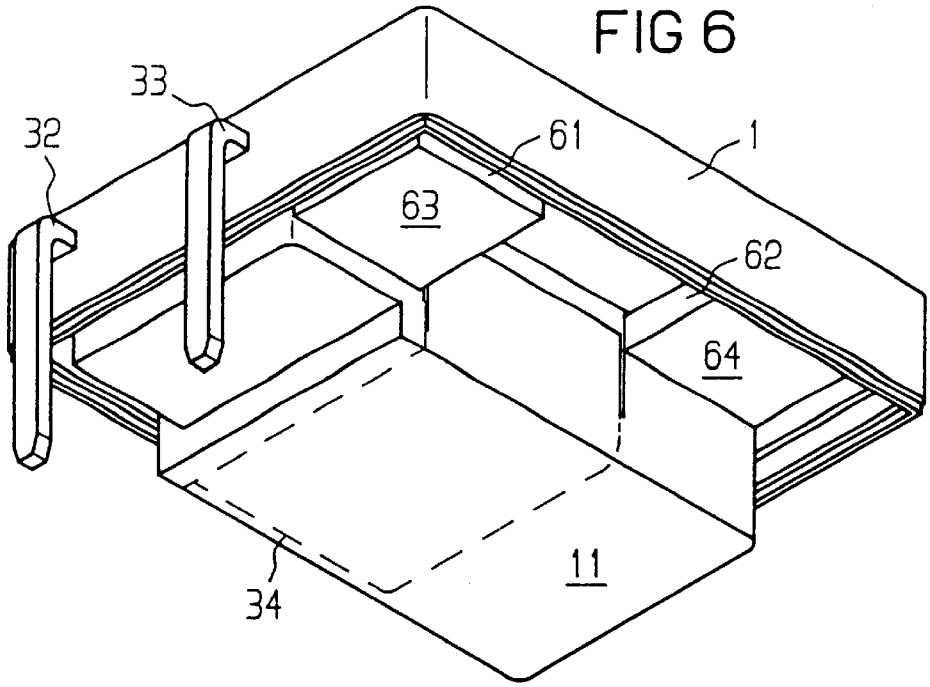
Figure 7:
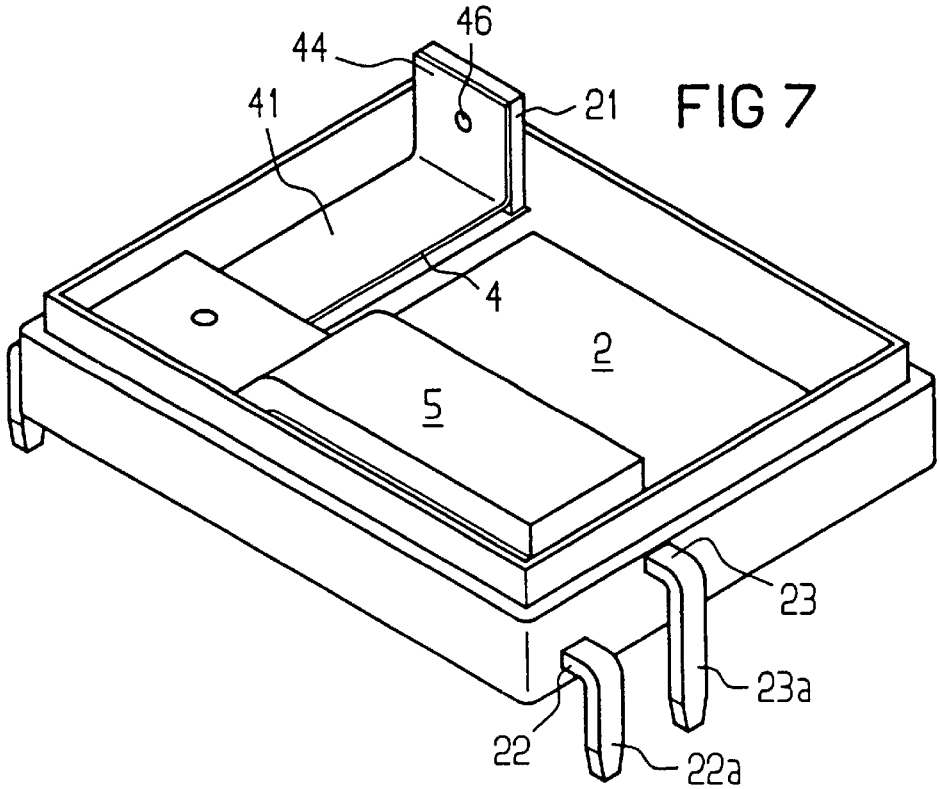
Figure 8:
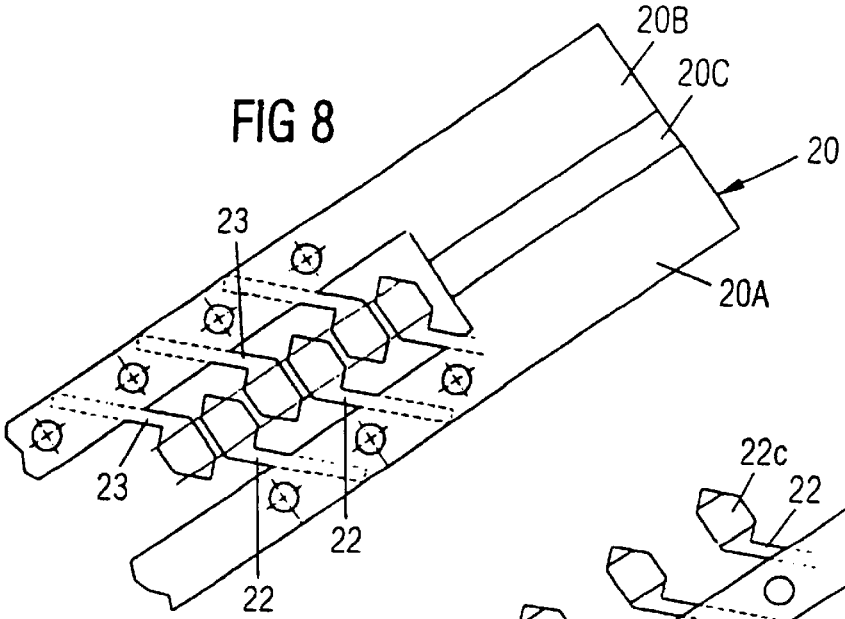
Figure 9:
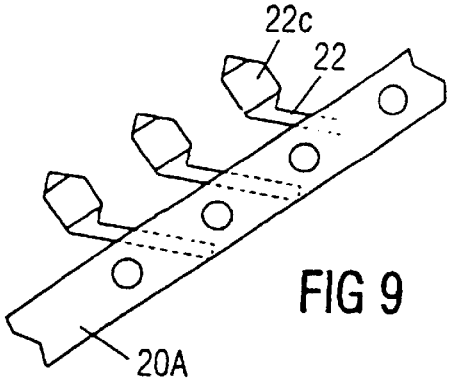
Figure 10:
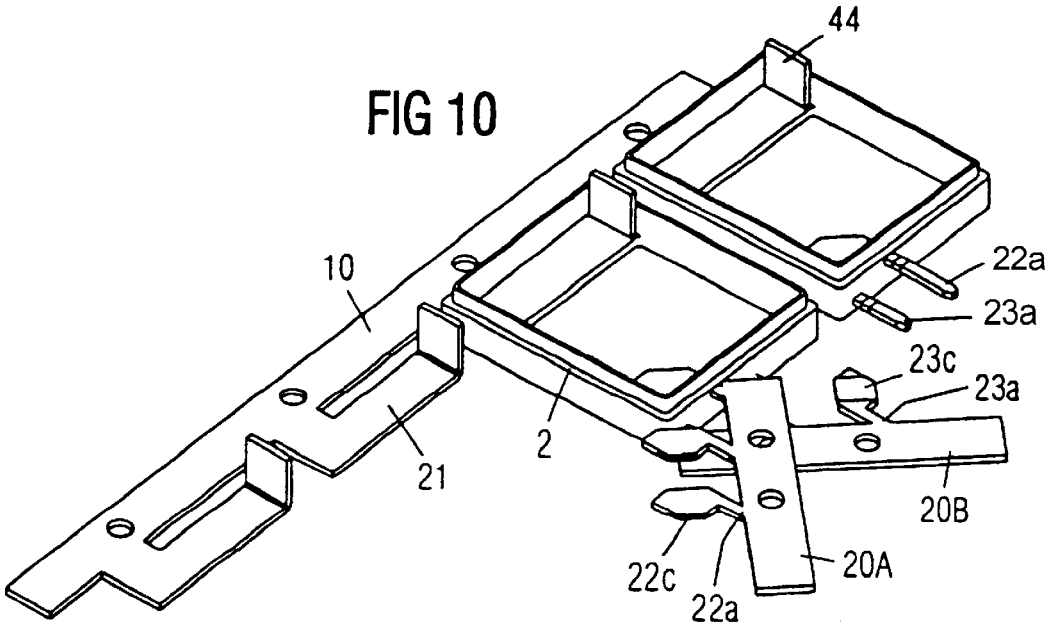
Figure 11A:
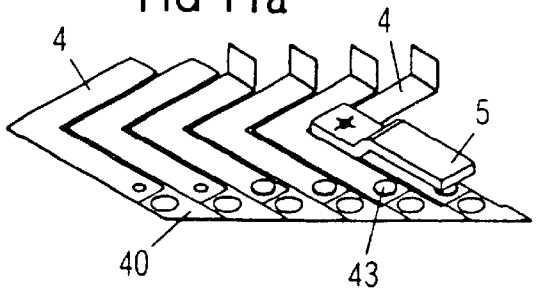
Figure 11B:
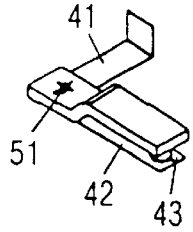
Figure 12:
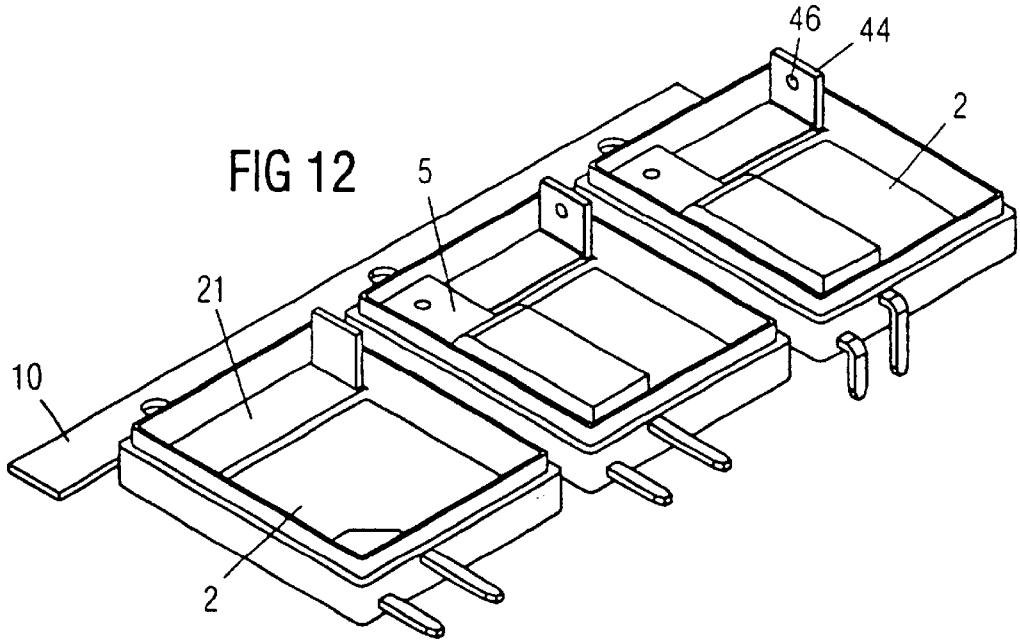
Figure 13:
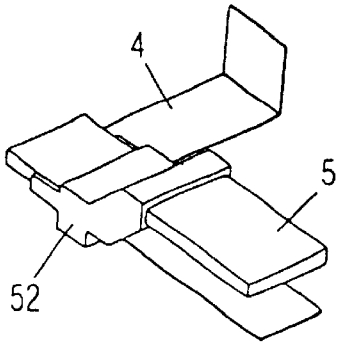
Figure 14:
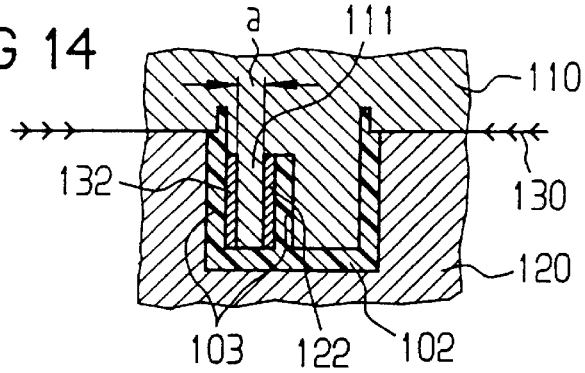
Figure 15:
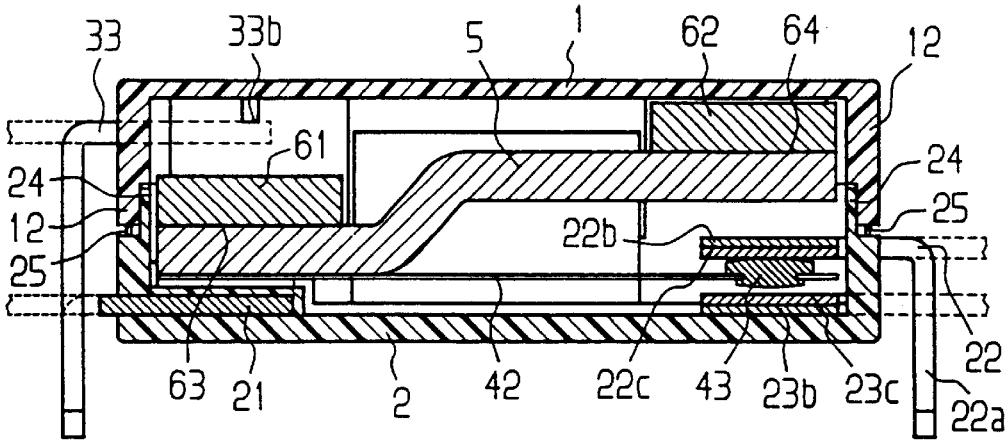
Figure 16:
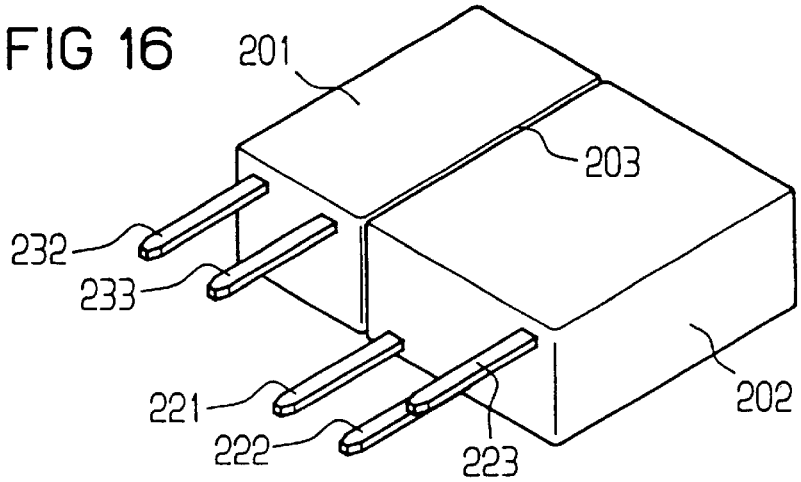

FIG. 1 shows a perspective, partially cutaway illustration of a relay produced in the manner according to the invention, FIG. 2 shows a sheet-metal strip with partially cut-out core yoke plates, FIG. 3 shows two sheet-metal strips with core yoke plates cut out as well as coil connecting pins, on which coil formers are formed by extrusion coating, FIG. 4 shows a sheet-metal strip with coil formers which are partially wound, FIG. 5 shows a sheet-metal strip of FIG. 4 with coil formers which are wound and are partially extrusion coated with plastic to form a first housing half-shell, FIG. 6 shows a separate first half-shell in a view rotated in comparison with the position of the half-shell in FIG. 5, FIG. 7 shows a complete second half-shell, FIG. 8 shows a contact sheet-metal strip with partially stamped-out fixed contact elements in two toothed rows, FIG. 9 shows a separate row of fixed contact elements which are attached to a sheet-metal strip, FIG. 10 shows the formation of two second half-shells by extrusion coating of fixed contact elements and spring supports, FIG. 11*a* shows a row of contact springs which have been stamped out on the strip and have been provided with an armature, FIG. 11*b* is a perspective view of a contact spring of FIG. 11*a* after separation from the strip, FIG. 12 shows a row, attached to the strip, of second housing half-shells, which have been provided with a spring/armature unit, FIG. 13 shows a modified form of a spring/armature unit, FIG. 14 is a schematic cross-sectional view of a modified embodiment of a housing half-shell, in an injection mold, FIG. 15 is a cross-section view through the armature of a relay which has been completed by placing two housing half-shells on top of one another, and FIG. 16 shows a perspective illustration of a modified embodiment of a relay produced according to the invention.

DESCRIPTION OF THE PREFERRED EMBODIMENTS

FIG. 1 shows a relay produced using the method according to the invention. This relay comprises a first half-shell 1 and a second half-shell 2. The half-shell 1 is formed by extrusion coating a coil 3, namely a coil former 31 with a winding 34, and the second half-shell 2 is formed by extrusion coating a spring support 21 as well as two fixed contact elements 22 and 23. An L-shaped contact spring 4 having two limbs 41 and 42 is attached to the spring support 21 and, for its part, is fitted with an armature 5. The ends of the armature 5, which is bent roughly in a Z-shape, each form air gaps with two pole surfaces 63 and 64 of two pole plates 61 and 62 which are part of a U-shaped core 6, and the pole plate 62 is bent upward out of the core plane.

The following figures show the individual method steps to produce the relay in FIG. 1. Thus, FIG. 2 shows the production of core yoke plates 6 which are successively cut out of a soft magnetic sheet-metal strip 60 and are bent at the production rate. FIG. 3 shows the sheet-metal strip 60 with the core yoke plate 6 in a later stage of the method, but still attached together. The core yoke plates 6 have in this case already been extrusion coated with a thermoplastic so that a coil former 31 has in each case been formed, in such a manner that the two pole plates 61 and 62 are free of plastic. Furthermore, two connecting pins 32 and 33 are embedded in the coil former 31 and are likewise attached to a sheet-metal strip 30. In this case, connecting sections 32*b* and 33*b* have also been cut out in the coil former, with which sections the winding ends will later make contact. At this point, it shall be mentioned that the coil connecting pins 32 and 33, on the one hand, and the core yoke plate 6, on the other hand, can also be manufactured from a common soft-magnetic sheet-metal strip, in which case the separation after the extrusion coating could be carried out in a corresponding manner.

As the procedure progresses, the coil former units formed by extrusion coating are separated on one side, for example from the sheet-metal strip 60, so that they are now attached only on one side, for example via the sheet-metal strip 30 according to FIG. 4. In this state, they are gradually provided with the winding 34, and the winding ends are connected to the connecting sections 32*b* and 33*b*.

Then, according to FIG. 5, the coil units are gradually extrusion coated, at the production rate, with a thermoplastic in order to form the half-shells 1, as is shown in FIG. 5. These extrusion-coated half-shells 1 are also still attached via the sheet-metal strip 30. The individual half-shells are then separated from the sheet-metal strip, and the cut-out coil connecting pins 32 and 33 are bent, as is shown in another view in FIG. 6. The coil including the winding is now completely sheathed by the plastic of the first half-shell 1, and only the pole surfaces 63 and 64 of the pole plates 61 and 62 are kept free of plastic.

The second housing half-shell 2 of the relay is shown in the complete state in FIG. 7. The subsequent figures show individual method sections during their production of the second housing half-shell 2. For example, FIG. 8 shows the production of fixed contact elements 22 and 23 from a sheet-metal strip 20 which is plated with a center strip 20C composed of contact material, for example AgNiO15, $AgSnO_2$ or the like. The contact material coating 20C is plated as an inlay into the strip material 20, so that it does not raise the surface at all, as a result of which the contact elements can easily be sealed in the injection mold. In order to save as much material as possible, the fixed contact elements 22 and 23 are, according to FIG. 8, cut out like zippers from the inlay-plated strip 20, so that the noble metal part of the plated layer 20C is used optimally. This results in two contact strips 20A and 20B, one of which is fitted with the make fixed contact elements 22, and other with the break fixed contact elements 23. FIG. 9 shows a contact strip 20A detached from the assembly, with the partially cut-out fixed contact elements 22 as well as their contact-making zone 22*c*.

As is shown in FIG. 10, the mutually twisted contact strips 20A and 20C are extrusion coated with the plastic material of the second half-shell 2, in which case the plated sections 22*c* and 23*c* face one another. As a result of the asymmetric design of the fixed contact elements 22 and 23, the contact-making sections 22*c* and 23*c* are located one above the other, while their connecting ends 22*a* and 23*a* are located offset with respect to one another in the wall of the half-shell 2. Furthermore, spring supports 21 are injection-molded during the injection molding of the half-shell 2 and are likewise attached to a common sheet-metal strip 10. The spring supports 21 each have a fastening lug 44 bent at right angles for the contact spring, which will be described later.

The second half-shell forms a cavity to accommodate the moving armature spring element 4, 5, which is shown in FIG. 11*b*. In this case, FIG. 11*a* shows a spring strip 40 from which the individual contact springs 4 are gradually cut out, bent and provided with the moving contacts 43, at the production rate. Finally, the armature 5, which is likewise cut from sheet metal and is bent in advance, is attached to the contact spring, for example via a spot weld 51. This armature/contact spring unit is then arranged in the second half-shell on the spring support 21 and is secured, for example, via a spot weld 46 (FIG. 12).

Alternatively, the contact spring 4 can be connected to the armature 5 by joint extrusion coating with a dielectric sheath 52, as is shown in FIG. 13. This results in electrical insulation between the contact spring 4 and the armature 5, and/or the magnet system.

In the injection mold, the distance between the two flat contact strips 20A and 20B (FIG. 10) is achieved which the high accuracy of a slide in the tool, so that a contact position in the subsequent relay is achieved with requires no adjustment. Alternatively, it is conceivable to work with an injection mold without any additional slide. To this end, the relay construction is arranged in the two half-shells such that the contact surfaces are at right angles in the second half-shell. A corresponding arrangement is shown schematically in FIG. 14, where a lower half-shell 102 is formed between two mold halves 110 and 120. Two fixed contact elements 122 and 132 with corresponding inlay contact coatings are arranged in this lower half-shell such that they are at right angles to the mold separating plane 130. A molding material projection 111 produces precisely the predetermined contact separation a between the two fixed contact elements 122 and 132 and seals the contact region well, since the pressure of the thermoplastic injection mold 103 for the half-shell 102 presses the two fixed contact elements 122 and 132 against this projection which produces the separation.

When the two half-shells 1 and 2 are being joined together according to FIG. 15, a circumferential wall 12 on the half-shell 1 engages like a box over the half-shell 2, which has a circumferential web 24 internally for this purpose. In order to achieve accurate adjustment of the distances between the magnet system and the contact system, one of the half-shells also has a circumferential rib 25 which is deformed during the joining process, for example by means of ultrasound, and produces a sealed joint between the two half-shells. In this way, the sealing process is very simple, since all the connections have already been extrusion coated to form a seal in the respective half-shell and the joint plane is formed by the thermoplastic on the two half-shells. The seal-in voltage of the armature is in this case measured while the two half-shells are being joined, the armature being attracted to the pole surfaces 63 and 64 of the pole plates 61 and 62. As soon as the seal-in voltage reaches a predetermined characteristic value as a measure of the corrosion magnitude and the overtravel of the contact, the joining process is ended. The relay is thus adjusted and at the same time sealed. A reliable seal of the two half-shells can alternatively be achieved using other technologies by means of the joint seam in a plane without any height difference, for example by bonding, clamping, potting or by an elastomer seal, which can be injection-molded on one half-shell using the two-component injection-molding method.

In FIGS. 1 and 15, the connecting pins of the relay are arranged on two opposite sides of the housing and are bent downward at right angles. They may thus be used as solder connecting pins or else as connecting elements for surface mounted devices, by bending them further to the horizontal. Alternatively, a different connection geometry is possible with an appropriate modification of the design, such that, if necessary, all the connecting elements emerge on one side of the housing. They may, of course, be designed either as solder pins or as blade connectors.

FIG. 16 shows another version of the relay, in which case all the connections emerge on any one side from the housing and the separation plane extends at right angles to the connection side of the relay. In this case as well, a first half-shell 20i contains the magnet system with the coil connecting pins 232 and 233, while the second half-shell 202 is fitted with the contact system with contact connecting pins 221, 222 and 223. In this case as well, the two half-shells are joined together along a separation plane 203, and adjustment can once again be carried out here with a corresponding design, by joining them together.

What is claimed is:

1. A method for producing an electromagnetic relay, the method comprising the steps of:

producing a first half-shell by forming a coil that has a core with spaced apart pole plates, a winding between the pole plates, and connecting pins extending from the coil by cutting the core and cutting the coil connecting pins out of a strip of sheet metal, extrusion-coating said core and said connecting pins jointly to form a core former with the pole plates remaining free and are then subsequently separated and then forming the winding by wrapping wire on said core former, molding the first half-shell upon the coil with the coil being embedded therein with the connecting pins exposed, the first half-shell having a first sealing edge;

producing a second half-shell by forming a contact spring support and contacts, molding the second half-shell about the spring support and the contacts with the contacts being exposed outside of the second half-shell, the second half-shell having a second sealing edge formed to correspond with the first sealing edge;

inserting am armature into one of the first half-shell and the second half-shell; and joining the two half-shells together with the first sealing edge engaging the second sealing edge.

2. A method according to claim 1, wherein the step of forming a contact spring support and contacts includes forming the spring support and the contacts on a strip of sheet metal.

3. A method according to claim 2, which includes coating a center section of the strip of sheet metal with free ends of the contacts alternately pointing in opposite directions with a part of the center sections abutting against one another.

4. A method according to claim 3, wherein the contacts are integrally formed in a plate plane with their contact making regions asymmetrical with respect to the axis of the connecting ends and in that during the production of the second half-shell, the contacts on the two fixed contact strips are arranged one above the other at an angle with respect to one another so that the coating sides of the contact making sections face one another and the connecting ends are offset parallel to one another.

5. A method according to claim 1, wherein the forming of the second half-shell includes injection-molding and the distance between two fixed contact elements is fixed exactly by a spacer element in an injection-mold.

6. A method for producing an electromagnetic relay, the method comprising the steps of:

producing a first half-shell by forming a coil that has a core with spaced apart pole plates, a winding between the pole plates, and connecting pins extending from the coil, molding the first half-shell upon the coil with the coil being embedded therein with the connecting pins exposed, the first half-shell having a first sealing edge;

producing a second half-shell by forming a contact spring support and contacts, molding the second half-shell about the spring support and the contacts with the contacts being exposed outside of the second half-shell, the second half-shell having a second sealing edge formed to correspond with the first sealing edge;

inserting an armature into one of the first half-shell and the second half-shell; and joining the two half-shells together with the first sealing edge engaging the second sealing edge, the joining of the two half-shells together includes measuring the armature travel and overtravel and ending the joining when a predetermined magnitude of the armature travel and overtravel is reached.

7. A method according to claim 6, which includes providing a rib on one of the two half-shells, said rib having an edge being deformed during the joining process until the predetermined armature travel and overtravel is reached.

8. A method for producing an electromagnetic relay, the method comprising the steps of:

producing a first half-shell by forming a coil that has a core with spaced apart pole plates, a winding between the pole plates, and connecting pins extending from the coil by cutting the core and cutting the connecting pins out of strips of sheet metal to form a plurality of cores and coil connecting pins for a plurality of relays, extrusion-coating said core and said connecting pins to form a core former with the pole plates remaining free, the extrusion-coating occurring with the pins still connected to their strip of sheet metal and the cores still connected to their strip of sheet metal and then forming the winding by wrapping wire on said core former, molding the first half-shell upon the coil with the coil being embedded therein with the connecting pins exposed, the first half-shell having a first sealing edge;

producing a second half-shell by forming a contact spring support and contacts, molding the second half-shell about the spring support and the contacts with the contacts being exposed outside of the second half-shell, the second half-shell having a second sealing edge formed to correspond with the first sealing edge;

inserting an armature into one of the first half-shell and the second half-shell; and joining the two half-shells together with the first sealing edge engaging the second sealing edge.

9. A method according to claim 8, wherein the step of wrapping the core former to form the winding occurs while the core formers are maintained on a common strip of sheet metal.

10. A method according to claim 9, wherein the step of molding the first half-shell with the coil embedded therein occurs while the coils are maintained on the common strip of sheet metal.

* * * * *